US008517218B2

(12) United States Patent
Chernov et al.

(10) Patent No.: US 8,517,218 B2
(45) Date of Patent: Aug. 27, 2013

(54) DISPENSER FOR DELIVERING SUBSTANCE FROM CONTAINER

(75) Inventors: Yuriy Chernov, Brooklyn, NY (US); Gennady Kleyman, Brooklyn, NY (US)

(73) Assignee: Klecher, LLC, Brooklyn, NY (US)

( * ) Notice: Subject to any disclaimer, the term of this patent is extended or adjusted under 35 U.S.C. 154(b) by 1299 days.

(21) Appl. No.: 11/360,006

(22) Filed: Feb. 22, 2006

(65) Prior Publication Data

US 2007/0194044 A1 Aug. 23, 2007

(51) Int. Cl.
*B65D 35/28* (2006.01)

(52) U.S. Cl.
USPC ..... 222/103; 222/107

(58) Field of Classification Search
USPC ..... 222/92–107, 333
See application file for complete search history.

(56) References Cited

U.S. PATENT DOCUMENTS

| | | | | | |
|---|---|---|---|---|---|
| 2,492,533 | A | * | 12/1949 | Olsen | 222/103 |
| 3,313,455 | A | * | 4/1967 | Kemmer | 222/103 |
| 3,860,147 | A | * | 1/1975 | Vessio et al. | 222/96 |
| 4,234,104 | A | * | 11/1980 | Apuzzo et al. | 222/94 |
| 4,448,333 | A | * | 5/1984 | Ferrari | 222/214 |
| 5,277,335 | A | | 1/1994 | Okami | |
| 5,501,369 | A | | 3/1996 | Tal | |
| 5,657,903 | A | | 8/1997 | Roberts | |
| 5,857,593 | A | | 1/1999 | Patronaggio | |
| 5,868,282 | A | * | 2/1999 | Imhoff | 222/101 |
| 6,302,298 | B1 | * | 10/2001 | Chernov et al. | 222/103 |
| 6,968,978 | B1 | * | 11/2005 | Matthews | 222/103 |
| 2005/0029294 | A1 | * | 2/2005 | Jackson | 222/95 |

* cited by examiner

*Primary Examiner* — Paul R Durand
*Assistant Examiner* — Andrew P Bainbridge
(74) *Attorney, Agent, or Firm* — Shvarts & Leiz LLP

(57) ABSTRACT

A slider including a squeezing mechanism, which is operative to uniformly deliver material from at least one collapsible container, and a track detachably coupled to the at least one collapsible container. The squeezing mechanism and track each are provided with a respective arrangement of engaging elements operative to mesh with one another during displacement of the squeezing mechanism along the track, which can be detached from the at least one collapsible container and coupled to a new collapsible container.

17 Claims, 6 Drawing Sheets

DISPENSER FOR DELIVERING SUBSTANCE FROM CONTAINER

BACKGROUND OF THE INVENTION

1. Field of the Invention

This invention relates to dispensing systems. Particularly, the invention relates to reusable dispensing systems operative to discharge the contents of various collapsible containers.

2. Description of the Prior Art

A wide variety of devices have been suggested and provided for the purpose of holding a collapsible tube, such as a tube of toothpaste, and gradually dispensing the contents. For example, U.S. Pat. No. 6,851,577 owned in common with the present invention and fully incorporated herein by reference discloses one of the known dispensing mechanisms.

The known prior art dispensing mechanisms are configured to be only used during the life of a given container. A need therefore exists for reusable dispensing mechanisms operating in an effective manner to effectively maximize squeezing a substance contained in containers.

SUMMARY OF THE INVENTION

The inventive dispenser meets these by objectives by providing a plurality of easily removable tracks having different configurations of engaging elements. The tracks can be easily removed from old containers and be reattached to new collapsible containers for further cooperation with squeezing mechanisms.

One of the advantages of the inventive dispenser is that it can be used with a variety of differently shaped and sized collapsible containers. Still another advantage of the inventive container is that the slider of the dispenser is provided with a configuration and dimension ensuring uniform contact with the outer periphery of the collapsible container during displacement of the slider. Further, due to the uniform distribution of pressing or squeezing forces imposed by the slider upon the collapsible container, a rate of distribution, at which material is discharged, is substantially constant. This, in turn, makes the inventive assembly usable in a variety of industries, in which a distributed uniform volume per unit of time is essential to a manufacturing process.

In accordance with another aspect of the invention, the dispenser is removably attached to a container. Since the inventive dispenser is configured for use with differently shaped and dimensioned collapsible containers, its multiple use provides the users with economical advantages.

Furthermore, a ratchet mechanism provided on the inventive assembly can help handicapped users in dosing the squeezable material in accordance with either prescribed dosage or desired dosage. The users can sense a desired dosage as a result of sound or increase in resistance to the displacement of the slider along the frame.

In a further aspect of the invention, tracks having a structured surface are removably attached containers and can be reattached to new containers for repeated use.

BRIEF DESCRIPTION OF THE DRAWINGS

The above and other objects, features and advantages will become more readily apparent from the detailed description accompanied by the following drawings, in which.

DETAILED DESCRIPTION

Figure 1:
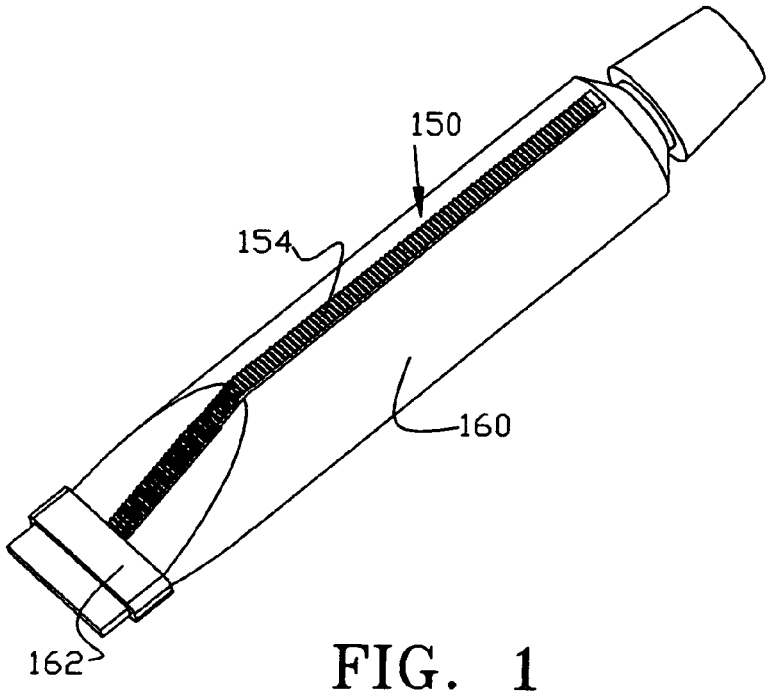
FIG. 1 is an isometric view of a container and a squeezing mechanism in the assembled state.

Reference will now be made in detail to several views of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, rear and front may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 2:
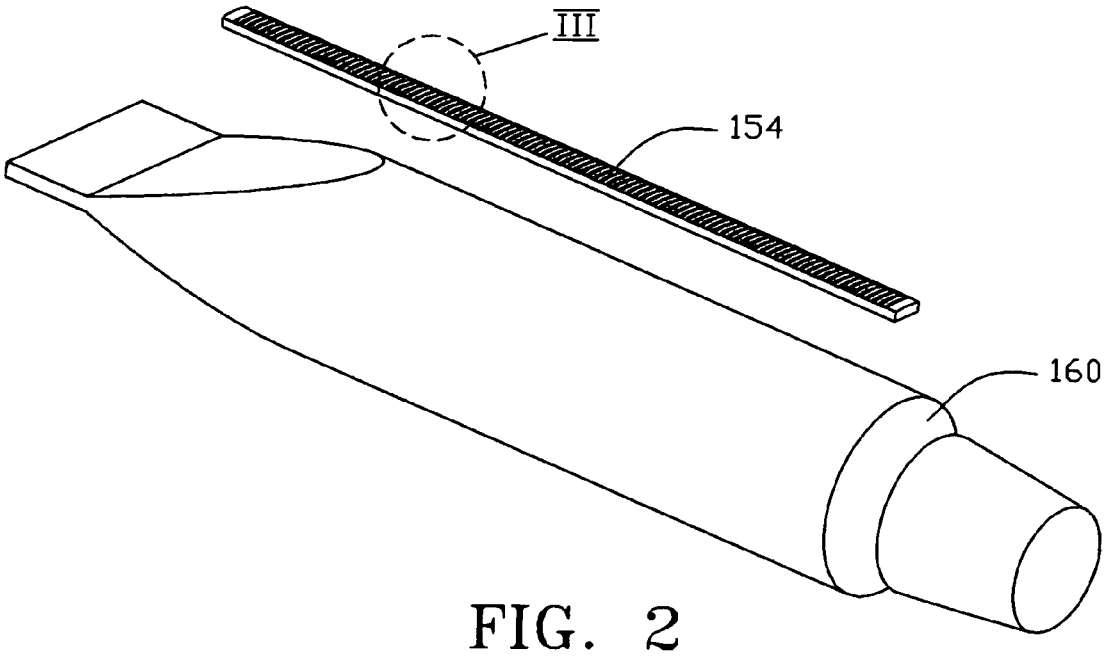
FIG. 2 is an exploded view of the container of FIG. 1.
Figure 3A:
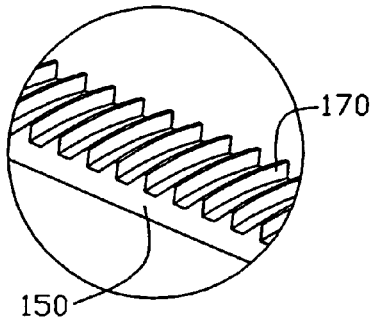
FIG. 3A, 3B, and 3C are perspective views each illustrating a respective inventive configuration of teeth.

In accordance with the present invention, illustrated in FIGS. 1-3, structured tracks 150 can be repeatedly reused with new containers after material from an old container 160 has been fully dispensed. Adhering tracks 150 to the container's surface may be realized by a variety of means. For example, an inner side 152 (FIG. 2) of track 150 may be provided with a layer of heat-activated glue. Alternatively, inner side 152 of track 150 may be provided with pressure-activated, force-activated activated and light-activated glue. In use, upon distributing the entire volume of material from container 160, track 150 is peeled off the container's body and reattached to a new container. Having attached track 150 to container 160, the user further proceeds with mounting a slider 162 (FIG. 1) to container 160. Once slider 162 is mounted on the container, the user applies a force sufficient to move slider 162 into engagement with track 150. The track 150 does not loose its adhering properties and can be reused with new containers. Materials used for making track 150 are selected so as to provide the track with flexibility necessary to conform to the contour of container 160 as a substance is squeezed out of the container. As an example, polymeric materials are well suited for the purposes of the present invention.

Outer side 154 of track 150 (FIG. 2) may be provided with a great variety of toothed arrangements configured to mesh with the similar arrangements on the inner side of slider 162.

Figure 3B:
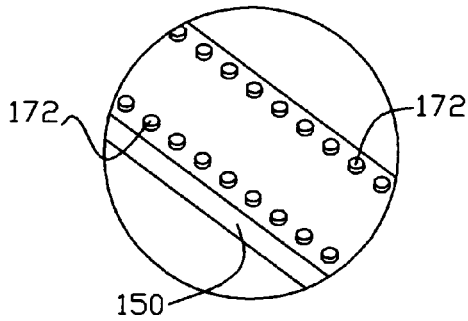
Figure 3C:
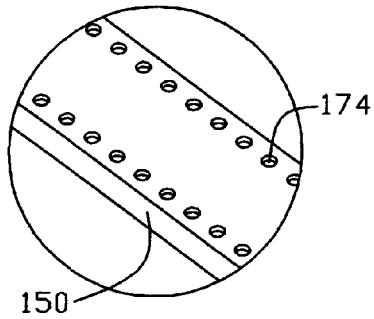

For example, outer side 154 of track 150 may have a row of parallel, spaced-apart ribs 170 (FIG. 3A) extending substantially along the entire length of track 150. Alternatively, as shown in FIG. 3B, two rows of projections 172, each extending along a respective longitudinal edge of track 150, can engage an arrangement of complementary indentations, which are formed on the inner side of slider 162 (not shown). Conversely, the projections may be provided on the inner side of slider 162, whereas, outer side 154 of track 150 may have an arrangement of indentations 174, as shown in FIG. 3C. Note that a pattern of meshing elements as well as their configuration are subject to numerous arrangements, provided that slider 162 and track 150 can reliably engage one another during displacement of slider 162 along container 160. The container 160 may have two spaced tracks having the same or different configuration of engaging formations.

Figure 4:
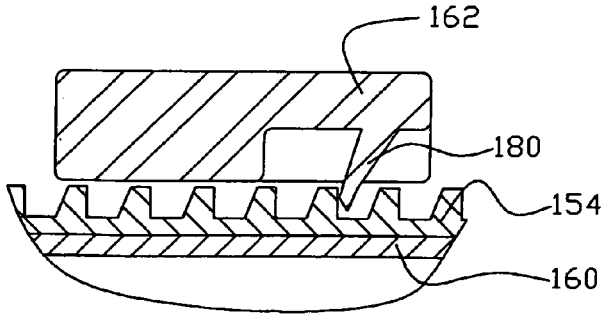
FIG. 4 is a side elevational view of a squeezing mechanism having a ratchet assembly which includes a releasing arm operable to allow displacement of the slider in opposite directions.

FIG. 4 illustrates slider 162 provided with a ratchet mechanism which includes a releasable arm 180 engaging formations on track 150. The ratchet mechanism allows displacement of slider 162 in a squeezing direction towards the front end of container 160 but prevents its displacement in the opposite direction unless arm 180 is actuated in a manner disclosed in U.S. Pat. No. 6,851,577 which, as mentioned above, is fully incorporated herein by reference.

Figure 5:
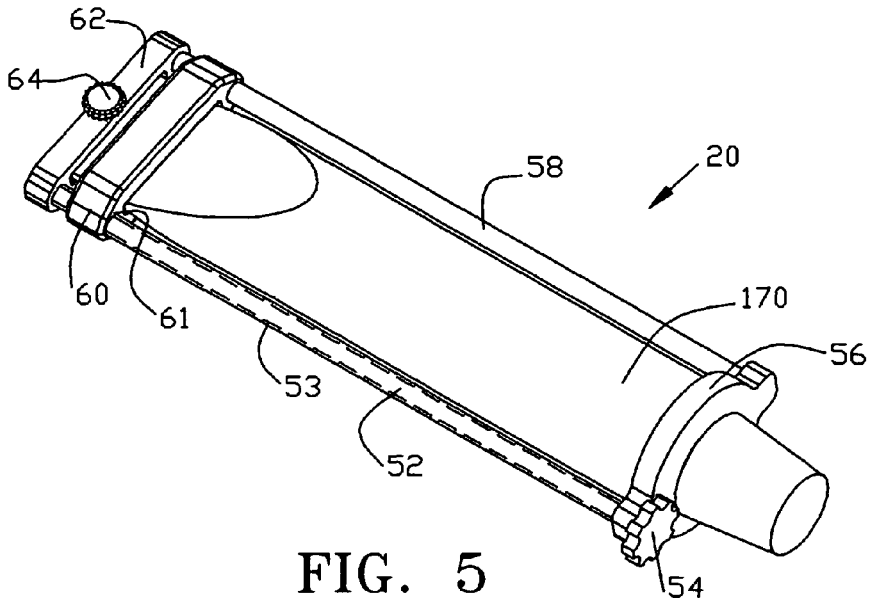
FIG. 5 is an isometric view of a container provided with a squeezing mechanism that is configured in accordance with a further embodiment of the invention.
Figure 6:
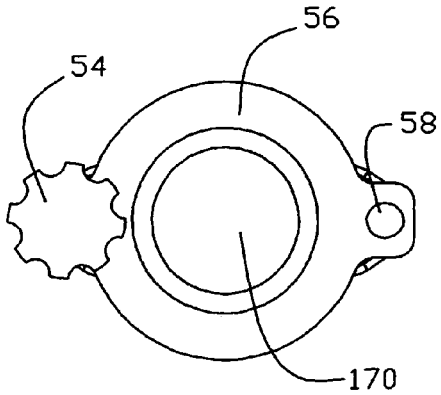
FIGS. 6 and 7 are front and rear views of the container and squeezing mechanism of FIG. 5, respectively.
Figure 7:
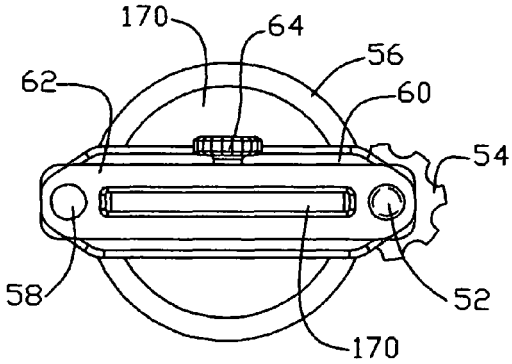

FIGS. 5-7 illustrate a further embodiment of a delivery or squeezing mechanism configured to controllably squeeze a substance from container 170. The mechanism has a front harness 56 mounted at the front end of container 170, a rear harness 62 juxtaposed with the bottom of container 170, a pair of guiding rods 52 and 58 extending between front and rear harnesses 56 and 62, respectively, and a slider 60.

To displace slider 60, a wheel 54 fixed to one of opposite the ends of rod 52, for example, the rod's front end, is actuated upon applying an external torque. As the wheel 54 rotates, a thread 53 engages a thread formed on an inner surface of passage 61 which is provided within slider 60. The opposite end of slider 60 is traversed by rod 58 having a smooth surface. As a result, rotation of wheel 54 causes slider 60 to move along both rods 52 and 58 in a stable manner while dispensing the substance from container 170 at a substantially uniform rate. The rear harness 62 is typically pushed on the bottom of container 170 and removably attached thereto by a thump screw or the like 64.

In use, the front harness is removably mounted onto container 170 so that rear harness surrounds the bottom of the container. After fixing the rear harness to the container's bottom, the user rotates wheel 54 so as to cause slider 60 to move along rods 52 and 58. Because of the threaded engagement between slider 60 and rod 52, reverse displacement of slider 60 is prevented. To dismount the squeezing mechanism, screw 64 is released allowing the user to pull the entire mechanism off used container 170. Advantageously, instead of thread 53 integrally formed on rod 52, a track as disclosed in reference to the embodiment of FIGS. 1-3 can be removably attached to the body of rod 52.

Figure 8:
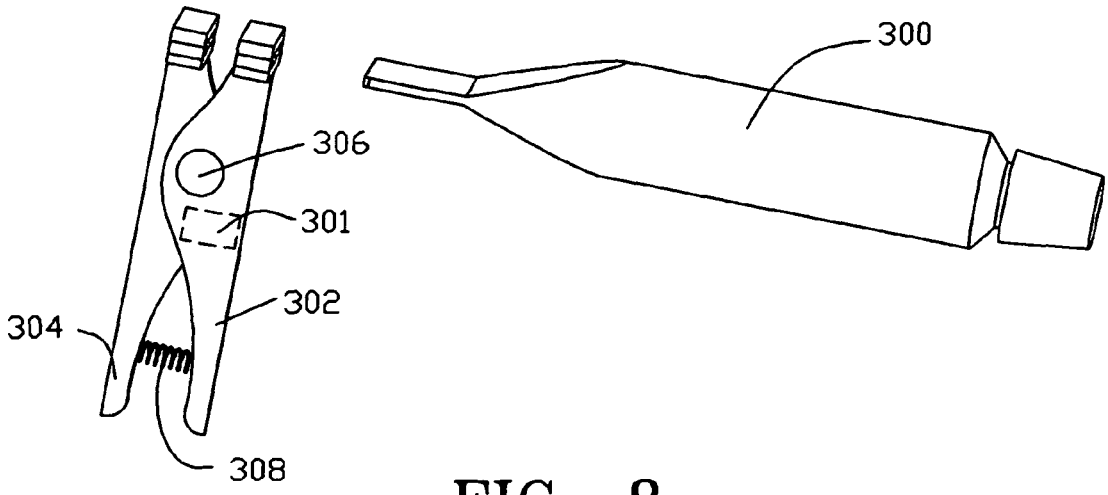
FIG. 8 is an exploded isometric view of a container and a squeezing mechanism configured in accordance with still a further embodiment of the invention.
Figure 9:
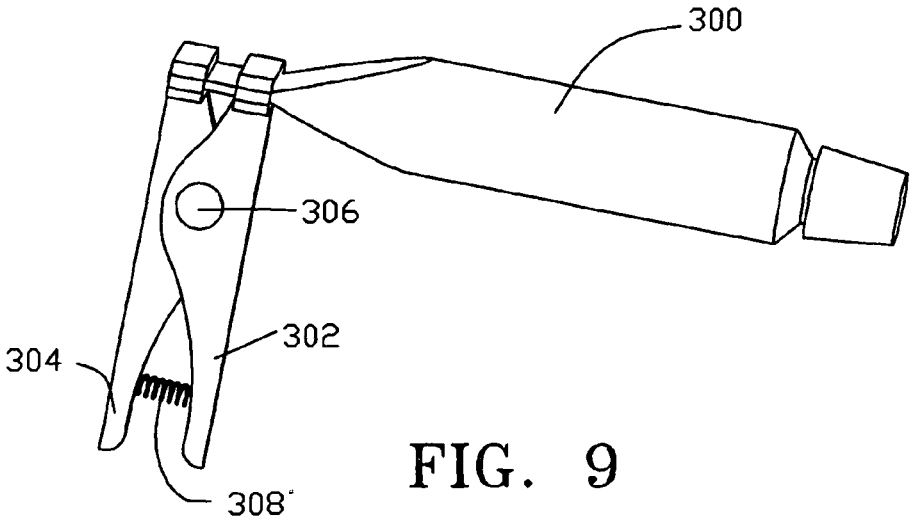
FIG. 9 is a side view of the assembled container and squeezing mechanism of FIG. 8.
Figure 10:
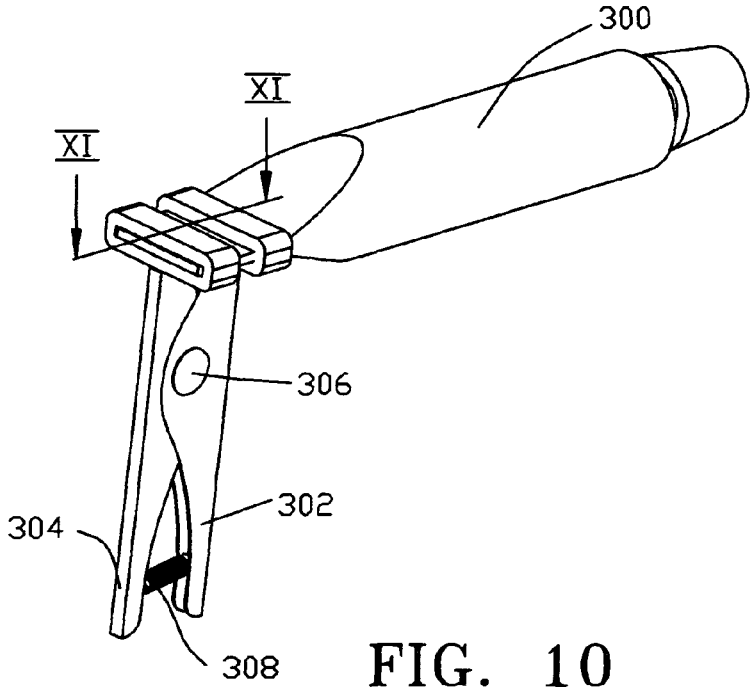
FIG. 10 is an isometric view of the assembled container and squeezing mechanism of FIGS. 8 and 9.

Turning to FIGS. 8-10, a slider is configured with two rocker arms 302 and 304 pivotal relative to one another about a pin 306. Top two ends of arms 302 and 304 each have an opening configured to receive the bottom of a container 300. The opposite bottom ends of arms 302 and 304 are biased against one another by a resilient element 308 which, in turn, is coupled to a cam mechanism 301 (FIG. 8) that is housed in one of or both arms 302 and 304 in the known manner.

Figure 11:
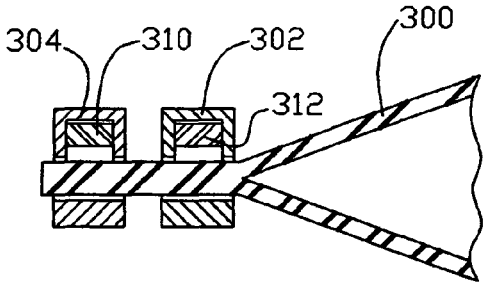
FIGS. 11-14 are cross-sectional views taken along lines XI-XI of FIG. 10 and illustrating the operational principle of the squeezing mechanism.
Figure 12:
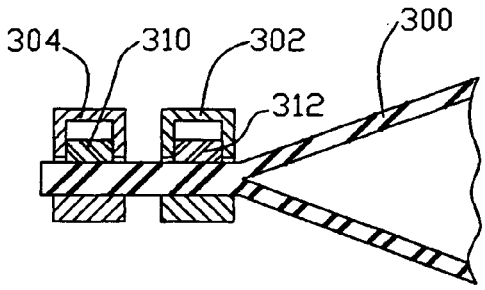
Figure 13:
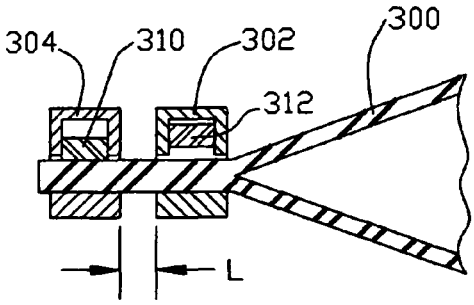
Figure 14:
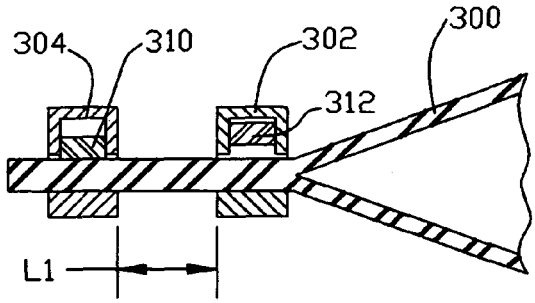

The operation of the slider is illustrated in FIGS. 11-14 and may be performed by a single hand. Initially, the bottom ends of arms 302 and 304 are squeezed against the force of resilient element 308. As a result, a pair of stoppers 310 and 312 displaceable within the respective openings of the top ends of the arms both clear the openings which are then traversed by the bottom of container 300, as illustrated in FIG. 11. Subsequently, the use removes the force applied to the bottom ends of arms 302 and 304 so as to bring the top ends of the arms closer to one another, whereas stoppers 310 and 312 upon the action of the cam mechanism engage the body of container 170, as shown in FIG. 12. Subsequently, applying a first force to the bottom ends of the arms, the cam mechanism operates so that front stopper 312 is moved away from rear stopper 310 allowing, thus, the top end of arm 302 to slide frontward from the top end of arm 304 and increase a distance therebetween from L (FIG. 13) to L1 (FIG. 14). Further, the user removes an applied force from arms 302 and 304 bringing, thus, rear arm 304 close to front arm 302. The process can continue in a stepwise manner, as explained above, until the entire volume of substance is dispensed from container 300. The length of arms 302 and 304 can be varied depending on physical properties of a substance to be distributed. For example, if a substance is characterized by high density, to facilitate its distribution, the arms may be dimensioned to be relatively longer than for a low-dense substance.

Figure 15:
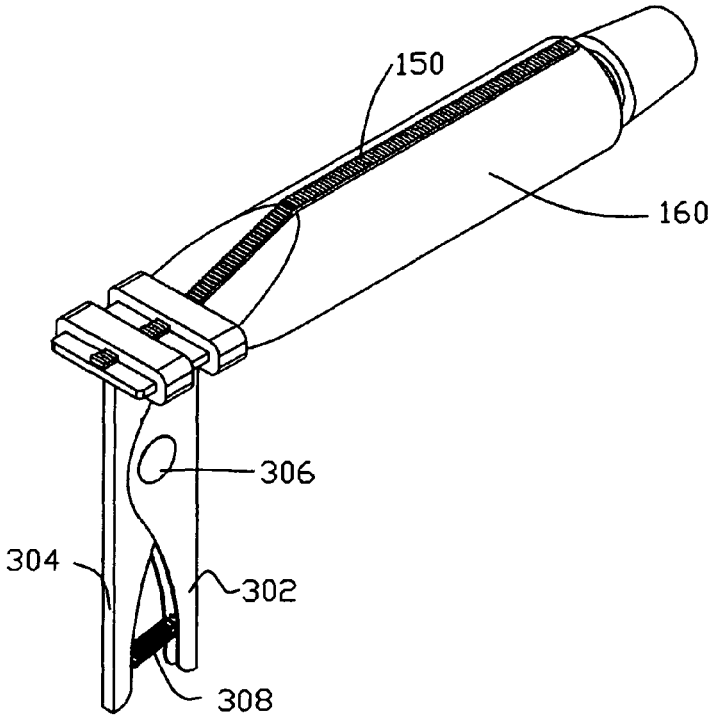
FIG. 15 is an isometric view of the assembled container and squeezing mechanism of FIG. 8 provided with removable tracks.

FIG. 15 illustrates a modification of the squeezing mechanism disclosed in reference to FIGS. 8-14. To improve reliability of engagement between stoppers 310 and 312 (FIGS. 11-14), at least one or more tracks 150 can be removably or fixedly attached to the body of container 160 in a manner explained in reference to FIGS. 1-3. The tracks 150 may have a structured surface provided with a variety of formations shown in FIGS. 3A-3C and capable of engaging complementary formations on the stoppers. Since container 160 (FIGS. 1 and 15) may have a variety of cross-sections including polygonal, circular and other regular or irregular cross-sections, the location of track 150 on container 160 can be varied in accordance with the choice made by a user. Since the slider does not deviate from a linear path, the inventive mechanism provides uniform distribution of not only single material, but also multiple materials from a container which, in this case, typically has one or more inner dividers preventing different materials to interact with one another within the container.

The specific features described herein may be used in some embodiments, but not in others, without departure from the spirit and scope of the invention as set forth. Many additional modifications are intended in the foregoing disclosure, and it will be appreciated by those of ordinary skill in the art that in some instances some features of the invention will be employed in the absence of a corresponding use of other features. For example, the inventive dispenser may have a plurality of tracks and containers as disclosed in aforementioned patent U.S. Pat. No. 6,851,577. The illustrative examples therefore do not define the metes and bounds of the invention and the legal protection is afforded the appended claims.

We claim:

1. A dispenser for delivering substance from at least one collapsible container, the dispenser comprising:

at least one reusable track extending between front and rear ends of the at least one collapsible container, said at least one reusable track detachably adhered to the container; and a slider, in direct contact with the container, detachably coupled to the track and dimensioned to surround and uniformly press against a periphery of the container while being displaced.

2. The dispenser of claim 1, wherein the slider has a recess dimensioned to receive a bottom of the collapsible container and having an inner surface juxtaposed with an outer surface of the at least one track, the track being detachably coupled to the periphery of the container, the juxtaposed inner and outer surfaces of the slider and track, respectively, being provided with meshing formations as the slider moves along the track.

3. The dispenser of claim 2, further comprising a ratchet mechanism configured to prevent rearward displacement of the slider upon meshing the formations, the ratchet mechanism having a releasing unit operative to provide the slider with the rearward displacement, the meshing formations including a plurality of openings provided on one of the inner and outer juxtaposed surfaces of the slider and track, respectively, and a plurality of projections provided on the other one of the inner and outer surfaces, the plurality of openings each being configured to receive a projection as the slider is displaced along the track.

4. The dispenser according to claim 2, wherein the meshing formations include a plurality of spaced ribs provided on the inner and outer surfaces of the slider and track, respectively, and meshing with one another as the slider is displaceable along the track.

5. The dispenser according to claim 1, wherein the track has an inner surface provided with an adhesive layer activated during coupling the track to the periphery of the container, the dispenser further comprising at least one additional track and at least one additional container.

6. The dispenser according to claim 5, wherein the adhesive layer is provided with a heat, pressure or force activated glue.

7. The dispenser according to claim 1, further comprising a front harness detachably mounted to the container next to a front end of the container, a rear harness surrounding a bottom of the container, and a pair of spaced rods extending between the front and rear harnesses and traversing the slider so that the slider is slidably guided therealong.

8. The dispenser according to claim 7, wherein one of the rods is rotatably supported by the front and rear harnesses and supports the track detachably coupled to a periphery of the one rod and having a first thread, the slider having a second thread engaging the first thread of the track to provide linear displacement of the slider along the rods during rotation of the one rod.

9. The dispenser according to claim 8, further comprising a wheel fixed to one of opposite ends of the one rod and operable to rotate in response to an external torque to actuate the one rod.

10. The dispenser according to claim 7, further comprising a screw traversing the rear harness and operable to prevent displacement between the rear harness and the track.

11. The dispenser according to claim 1, wherein the slider has a pair of arms each extending between opposite ends, the arms being pivotally coupled to one another to provide the slider with displacement along the track.

12. The dispenser according to claim 11, further comprising a pin traversing intermediate regions of the arms located between the opposite ends thereof as to provide pivotal motion of the arms relative to one another.

13. The dispenser according to claim 12, wherein first ends of the arms have respective openings configured to receive a bottom of the container, second ends of the arms opposite the first ends being biased away from one another.

14. The dispenser according to claim 13, wherein each opening of the arms has a stopper displaceably mounted in the opening and operable to engage the track.

15. The dispenser according to claim 14, wherein opposing surfaces of each of the stoppers and the track have respective formations engaging one another during displacement of the slider along the track.

16. The dispenser according to claim 14, further comprising a resilient element biasing the second ends of the arms from one another and a cam mechanism actuated by the resilient element, the cam mechanism being operable to controllably actuate each of the stoppers depending on a magnitude of an external force applied to the resilient element.

17. The dispenser according to claim 11, wherein the track is detachably coupled to the periphery of the container.

* * * * *